US006398594B1

(12) United States Patent
Bonilla et al.

(10) Patent No.: US 6,398,594 B1
(45) Date of Patent: Jun. 4, 2002

(54) TWO-PIECE ELECTRICAL RECEPTACLE HOUSING HAVING A BARBED POST AND RESILIENT HOOP CONNECTION

(75) Inventors: Nelson Bonilla, West Haven; Joseph V. DeBartolo, Jr., North Stonington, both of CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/803,372

(22) Filed: Mar. 12, 2001

(51) Int. Cl.[7] ..... H01R 13/514
(52) U.S. Cl. ..... 439/731; 439/107
(58) Field of Search ..... 439/107, 106, 439/535, 650, 731, 906; 220/3.94, 3.92, 326

(56) References Cited

U.S. PATENT DOCUMENTS

| | | | | |
|---|---|---|---|---|
| 3,668,476 A | | 6/1972 | Wrabel et al. | 317/101 |
| 3,757,031 A | | 9/1973 | Izraeli | 174/138 |
| 3,840,152 A | * | 10/1974 | Hodge | 220/3.92 |
| 3,868,161 A | | 2/1975 | Frantz | 339/14 R |
| 3,908,154 A | | 9/1975 | Gryctko | 317/18 |
| 4,001,652 A | | 1/1977 | Klein et al. | 317/112 |
| 4,039,902 A | | 8/1977 | Lacan et al. | 361/395 |
| 4,209,762 A | | 6/1980 | Samborkski et al. | 335/18 |
| 4,236,128 A | | 11/1980 | Cooper et al. | 335/18 |
| 4,295,180 A | | 10/1981 | Herron et al. | 361/383 |
| 4,345,225 A | | 8/1982 | Lemmer | 335/132 |
| 4,379,605 A | | 4/1983 | Hoffman | 339/14 R |
| 4,500,746 A | | 2/1985 | Meehan | 174/48 |
| 4,500,943 A | | 2/1985 | Greene | 361/383 |
| 4,507,709 A | | 3/1985 | Morris et al. | 361/400 |
| 4,549,241 A | | 10/1985 | Morris et al. | 361/45 |
| 4,627,679 A | | 12/1986 | Billette de Villemeur et al. | 339/21 |
| 4,641,216 A | | 2/1987 | Morris et al. | 361/45 |
| 4,716,493 A | | 12/1987 | Zelkowitz | 361/383 |
| 4,872,081 A | | 10/1989 | Murphy et al. | 361/117 |
| 4,872,087 A | | 10/1989 | Brant | 361/356 |
| 4,896,784 A | * | 1/1990 | Heath | 220/3.94 |
| 4,939,615 A | | 7/1990 | Brant et al. | 361/42 |
| 5,472,350 A | | 12/1995 | Mehta | 439/107 |
| 5,510,760 A | | 4/1996 | Marcou et al. | 335/18 |
| 5,531,345 A | * | 7/1996 | Nakamura et al. | 220/326 |
| 5,577,779 A | * | 11/1996 | Dangel | 220/326 |
| 5,594,205 A | | 1/1997 | Cancellieri et al. | 174/53 |
| 5,613,874 A | | 3/1997 | Orlando et al. | 439/491 |
| 5,839,908 A | | 11/1998 | Bonilla et al. | 439/107 |
| 6,015,303 A | | 1/2000 | Bonilla et al. | 439/107 |

* cited by examiner

*Primary Examiner*—Tulsidas Patel
*Assistant Examiner*—Phuong K T Dinh
(74) *Attorney, Agent, or Firm*—Jeffrey J. Howell; Mark S. Bicks; Alfred N. Goodman

(57) ABSTRACT

A ground fault receptacle housing for an electrical device having a backing portion with a base and a wall extending from the base. The wall has a hoop portion that forms an exterior channel extending therethrough. A cover portion is adapted to couple to the backing portion and has a front face with apertures therein for access to the electrical device. A wall extends from the front face and has a substantially inflexible post extending from the wall. The post has a body portion and a tapered protrusion thereon, the protrusion having a largest perimeter that is greater than at least a perimeter in portion of the exterior channel. When the protrusion passes through the channel, at least a portion of the hoop portion stretches, while the wall extending from the base of the backing portion remains substantially stationary. The protrusion is adapted to engage the end surface of hoop portion after passing through the channel, while the body portion of the post is positioned within the channel without substantially stretching the hoop portion when the protrusion engages the end surface.

27 Claims, 5 Drawing Sheets

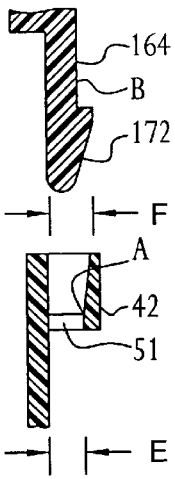
FIG. 11a
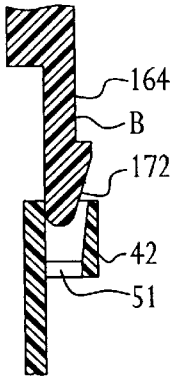
FIG. 11b
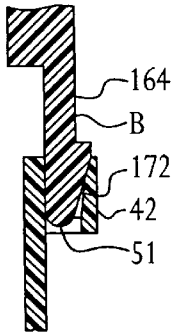
FIG. 11c
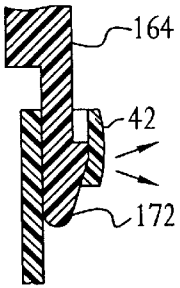
FIG. 11d
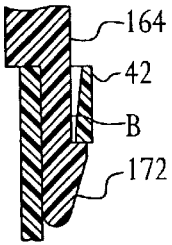
FIG. 11e
FIG. 12a
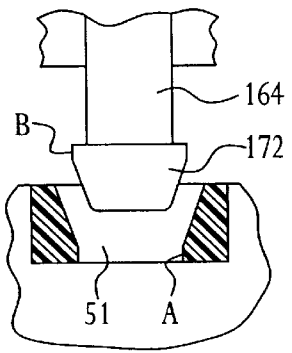
FIG. 12b
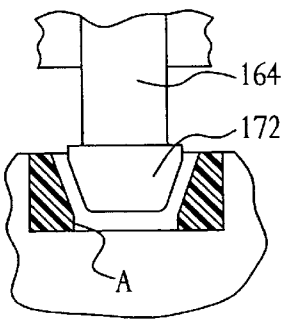
FIG. 12c
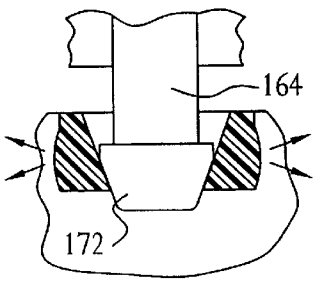
FIG. 12d
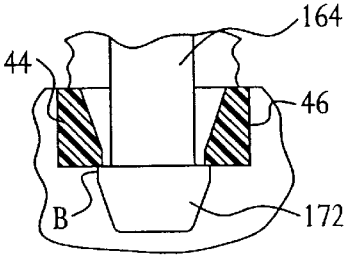
FIG. 12e

TWO-PIECE ELECTRICAL RECEPTACLE HOUSING HAVING A BARBED POST AND RESILIENT HOOP CONNECTION

FIELD OF THE INVENTION

The present invention relates to the assembly of an electrical receptacle housing. More particularly, the present invention relates to the assembly of a two-piece ground fault receptacle housing having multiple barbed posts on a first portion of the housing that couple to respective resilient hoops on a second portion of the housing.

BACKGROUND OF THE INVENTION

Many conventional electrical receptacle housings employ a two-piece housing that is formed by separate mateable front and back covers. The covers generally mate together using any know means, such as screws, rivets, or snap-fit. A mounting bridge with ears at opposite ends generally extends between the front and back covers and allows the housing to be attached to a suitable structure, such as a building wall or an electrical box. In some electrical receptacle designs, the mounting bridge has a generally U-shape so as to wrap around portions of the mated front and back covers of the housing and couples to the front and back covers. In other electrical receptacle designs, the mounting bridge is a relatively flat shape and is disposed between the mated front and back covers of the housing. The bridge can be coupled to the housing using any mechanical fasteners, such as screws or rivets.

In many conventional receptacle housings, the two-piece housing is coupled together using fasteners or screws, as described above. This fastener type housing forms a rigidly secured, hard to separate housing, but is cumbersome and difficult to assemble. In many situations, it is necessary to assemble many housings, each having multiple fasteners, creating a time consuming, tedious job.

Additionally, other conventional receptacle housings have a snap-fit design, wherein the front cover snaps to the back cover, holding the bridge in-between. Several designs of snap-fit of housings for electrical receptacles are disclosed in U.S. Pat. No. 4,872,087 to Brant, U.S. Pat. No. 5,510,760 to Marcou et al and U.S. Pat. No. 6,015,303 to Bonilla et al., which are herein incorporated by reference. A design of a snap-fit housing for an accessory strip to an outlet cover plate is disclosed in U.S. Pat. No. 5,613,874 to Orlando et al., which is herein incorporated by reference. While these prior art snap-fit designs allow a quick assembly of the housing without the use of screws or rivets, they do not provide a rigidly coupled housing. In many instances the two housing portions can be twisted or pulled apart relatively easily, thus exposing the electrical receptacle to the outside environment and the installer/user, and possibly causing electrical shock to the installer/user or damage to the electrical receptacle.

Consequently, a need still remains for a snap-fit housing for an electrical receptacle that is quick and easy to assemble, while simultaneously providing a housing that is difficult or unlikely to be pulled or twisted apart.

SUMMARY OF THE INVENTION

Accordingly, an object of this invention is to provide an improved electrical receptacle housing.

Another object of this invention is to provide an electrical receptacle housing, which can be easily and rapidly assembled.

Still another object of this invention is to provide an electrical receptacle housing having a two-part housing, which is difficult to disassemble.

Yet Another object of the present invention is to provide an electrical receptacle housing having a two-piece housing, which are coupled together using a snap-fit connection, rather than the more conventional fastening means.

The foregoing objects are basically attained by providing a electrical wiring device housing, comprising a first section having a first wall, a first side wall extending from the first wall, and a connecting unit extending from the first side wall. The connecting unit has a connecting wall that has a normally substantially planar configuration and is spaced from the first side wall and an end wall that is adjacent the connecting wall. The housing also comprises a second section that has a second wall, a second side wall extending from the second wall, and a post extending from the second wall. The post has a barb at the distal end thereof, the barb is adapted to pass between the connecting wall and the first sidewall and engage the end wall of the connecting unit. The first side wall remains substantially stationary while at least a portion of the connecting wall flexes away from the first side wall when the barb passes therebetween, and the connecting wall returns to the normally substantially planar configuration when the barb engages the end wall.

By forming a electrical wiring device housing in this manner, the housing is quick and easy to assembly and is extremely difficult to disassemble.

Other objects, advantages and salient features of the invention will become apparent from the following detailed description, which, taken in conjunction with the annexed drawings, discloses preferred embodiments of the invention.

As used in this application, up, down, upper and lower refer to relative directions depending on the orientation of the two pieces of the housing relative to each other, and do not limit the housing to any specific orientation.

BRIEF DESCRIPTION OF THE DRAWINGS

Referring to the drawings which form a part of this disclosure:

FIGS. 11*a–e* is a partial side view in section of the barb and hoop portion of the housing in FIG. 1 being coupled together.

FIGS. 12*a–e* is a partial end view in section of the barb and hoop portion of the housing in FIG. 1 being coupled together.

DETAILED DESCRIPTION OF THE INVENTION

Figure 2:
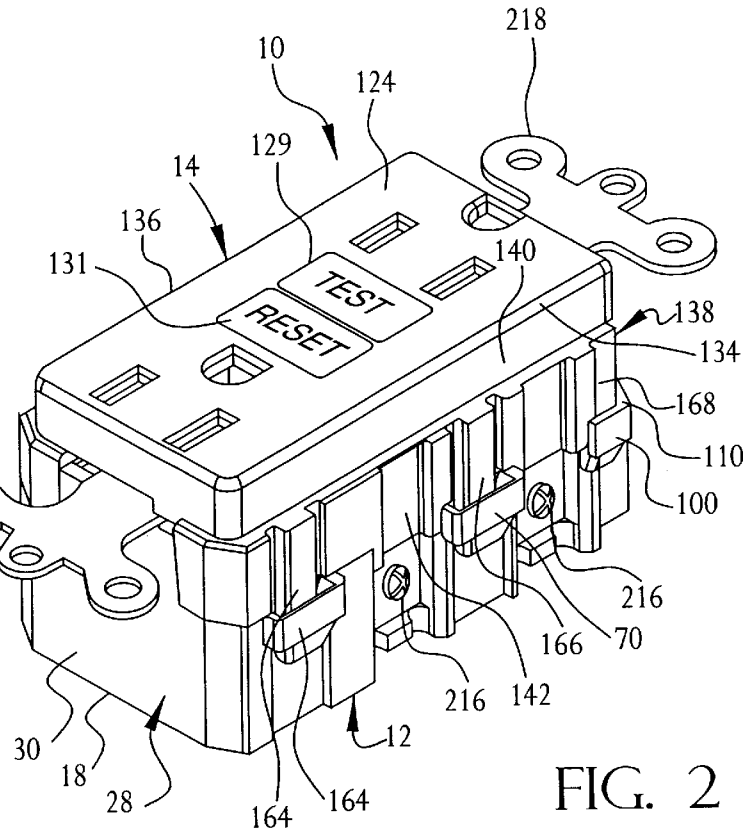
FIG. 2 is a top perspective view of the housing of FIG. 1, after engagement of the first and second pieces of the housing and with the electrical receptacle therein.

FIGS. 1–4 illustrate an electrical wiring device housing 10 in accordance with a preferred embodiment of the present invention. Wiring housing 10 is a ground fault interrupter receptacle for preferably housing an electrical duplex outlet 11; however, wiring housing 10 can house any electrical device desired. Housing 10 preferably has a first section 12 and a second section 14 that can be coupled together in such a manner that they are difficult to disassemble.

The electrical duplex outlet 11 is preferably a conventional electrical duplex outlet as is known to one skilled in this art and has a bridge 218 for coupling to an outlet box or any other device, attaching members or screws 216 for connecting electrical wiring, specifically hot and neutral wires, and attaching member or screw 220 for connecting electrical wiring, preferably a ground wire.

First section or backing portion 12 (FIGS. 3 and 4) is preferably formed of a plastic material, such as nylon (specifically, ZYTEL 101F-NC10) but can be any thermoplastic, polymer or synthetic nonconductive material. ZYTEL 101F NC010 is sold by DuPont and is an internally lubricated PA 66 that has been developed for fast cycles and high productivity and has the following mechanical properties measured at about 23° C.:

| | | | Value | |
|---|---|---|---|---|
| Property | Test Method | Units | 50% RH | DAM |
| Yield Stress 50 mm/min | ISO 527-1/2 | MPa | 53 | 83 |
| Nominal Strain at Break 50 mm/min | ISO 527-1/2 | % | >50 | 18 |
| Yield Strain 50 mm/min | ISO 527-1/2 | % | 25 | 4,4 |
| Tensile Modulus 1 mm/min | ISO 527-1/2 | MPa | 1200 | 3100 |

ISO = International Standards
MPa = Mega Pascal
RH = Relative Humidity
DAM = Dry as Molded Organization First section 12 is preferably a molded portion of the housing having a substantially smooth, planar surface or first wall 16. Backing portion 12 has a first end 18, a second end 20, a first side 22, a second side 24, and is surrounded by a perimeter wall 26. Wall 26 extends substantially perpendicularly from planar surface 16. Wall 26 is formed of several different sidewalls or sections.

Figure 1:
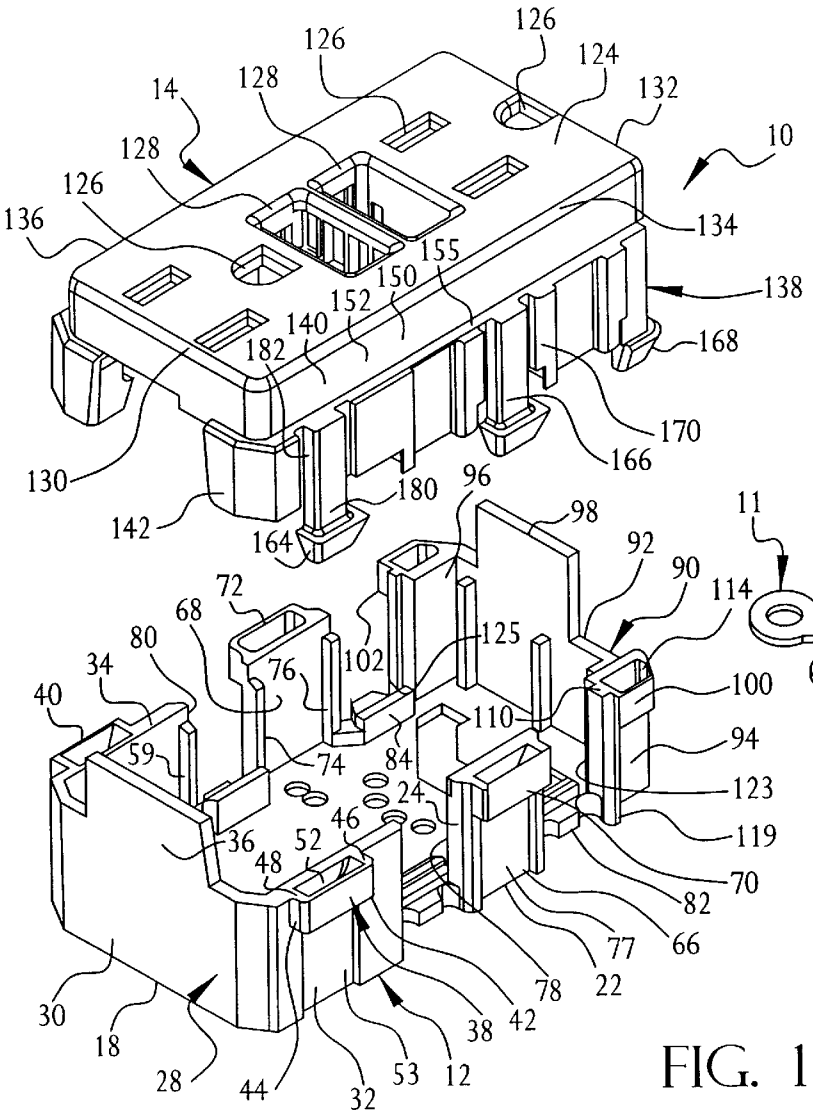
FIG. 1 is top perspective view of a two-piece housing according to the preferred embodiment of the present invention, prior to engagement of the first and second pieces of the housing.
Figure 4:
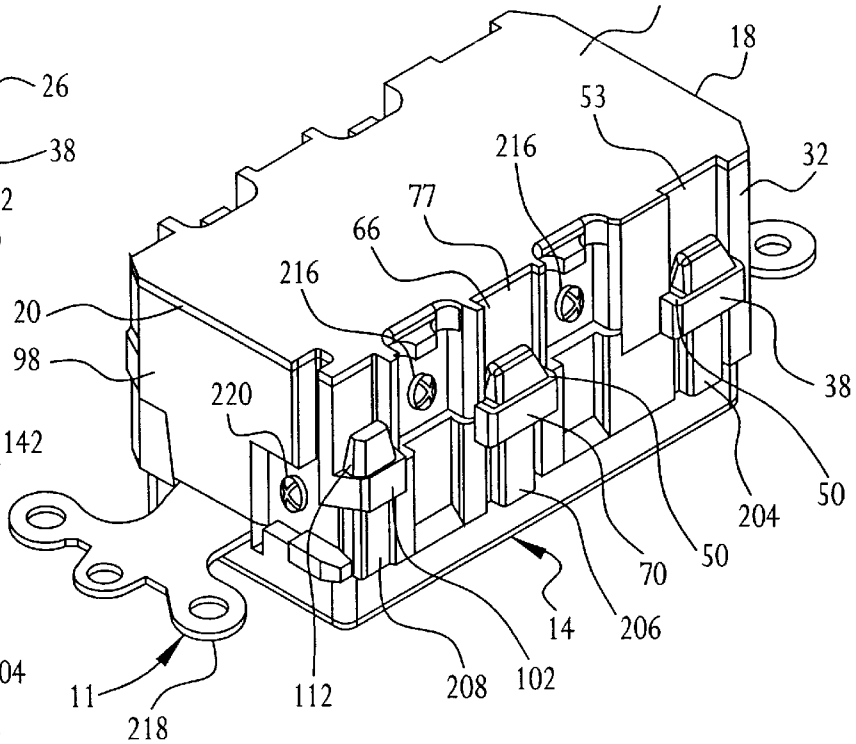
FIG. 4 is a bottom perspective view of the housing of FIG. 2.
Figure 7:
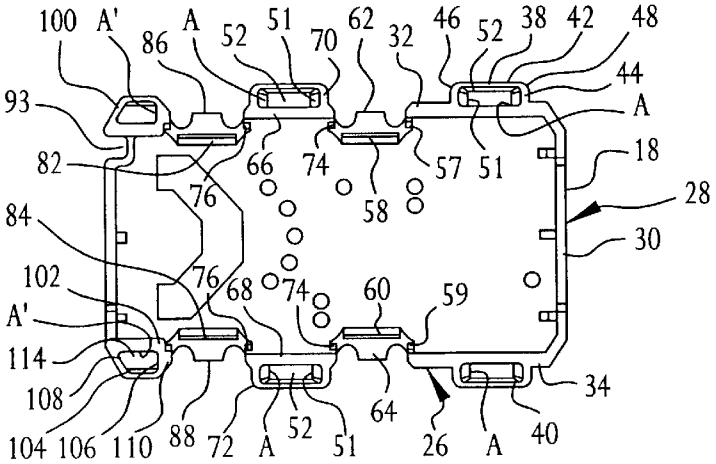
FIG. 7 is a top plan view of the first piece of the housing of FIG. 1

As can be seen specifically in FIGS. 1 and 7, perimeter wall 26 has a U-shaped portion 28 that extends from first end 18. The U-shaped portion is comprised of three, preferably unitary or integrally formed sections or substantially rigid base walls 30, 32 and 34. Section 30 extends along substantially the entire length of first end 18 and substantially perpendicularly from planar surface or base 16. Sections 32 and 34 each extend along a portion of sides 22 and 24, respectively and substantially perpendicularly from planar surface 16. However, sections 30, 32 and 34 do not necessarily need to be unitary and can be separate if desired and can extend at any suitable angle relative to planar surface 16.

As seen in FIGS. 1, 2, 7 and 8 section 30 has a substantially rectangular protrusion or extension 36 that projections away from planar surface 16 and is substantially coplanar with section 30. Sections 32 and 34 each have a hoop portion or connecting unit 38 and 40, respectively, integrally or unitarily formed thereon. However, hoop portions 38 and 40 may be coupled to sections 32 and 34 in any suitable manner desired. Hoop portions 38 and 40 are substantially similar so only one will be described herein.

Hoop portion 38 is formed from three separate walls or portions 42, 44 and 46. The three walls of the hoop portion 38 and section 32 are integrally formed or coupled together to define a continuous resilient hoop having a substantially rectangular through passageway or external channel 52. Channel 52 however, does not have to be substantially rectangular and the walls 42, 44 and 46 and section 32 can be configured to form any shape channel desired. Portion or connecting wall 42 preferably has a normally substantially planar configuration and is substantially parallel to and spaced from section 32. Walls 44 and 46 preferably extend substantially perpendicular from and are preferably unitary with section 32 and wall 44. Each hoop portion has a first end 48 and a second end 50, which are defined by the end surfaces of walls 42, 44 and 46, as shown in FIGS. 1–4. As seen in FIGS. 11*a–e* and 12*a–e* the interior portion of walls 42, 44 and 46 taper downwardly and inwardly. The interior portion of wall 42 is preferably about 0.242±0.005 inches at its shortest length D and about 0.342±0.005 at its widest. The interior portion of walls 44 and 46 are preferably about 0.08±0.005 inches at their shortest length E and about 0.10±0.005 at their widest. The short length of walls 42, 44 and 46 and wall 32 form a narrow portion 51 of in through passageway 52. Narrow portion 51 has a perimeter A. Perimeter A is preferably about 0.644 inches, but may be any measurement that allows the housing to couple together as described herein and walls 42, 44 and 46 do not necessarily need to be the lengths stated and may be any length desired. Additionally, each wall 32 and 34 has a groove or trench 53 and 55, respectively, on the exterior surface of the wall and a ridge 57 and 59, respectively, in the interior surface.

Adjacent U-shaped portion 28 (FIGS. 1 and 7) are two shorter or lower portions or walls 58 and 60 that are preferably unitary with and extend substantially perpendicular to planar surface 16. Walls 58 and 60 are recessed slightly inwardly toward the center of surface 16, relative to U-shaped portion 28, and each wall 58 and 60 has a protrusion 62 and 64, respectively extending outwardly and substantially parallel with planar surface 16 therefrom. Protrusions 62 and 64 extend to about the same distance as U-shaped portion 28.

Figure 3:
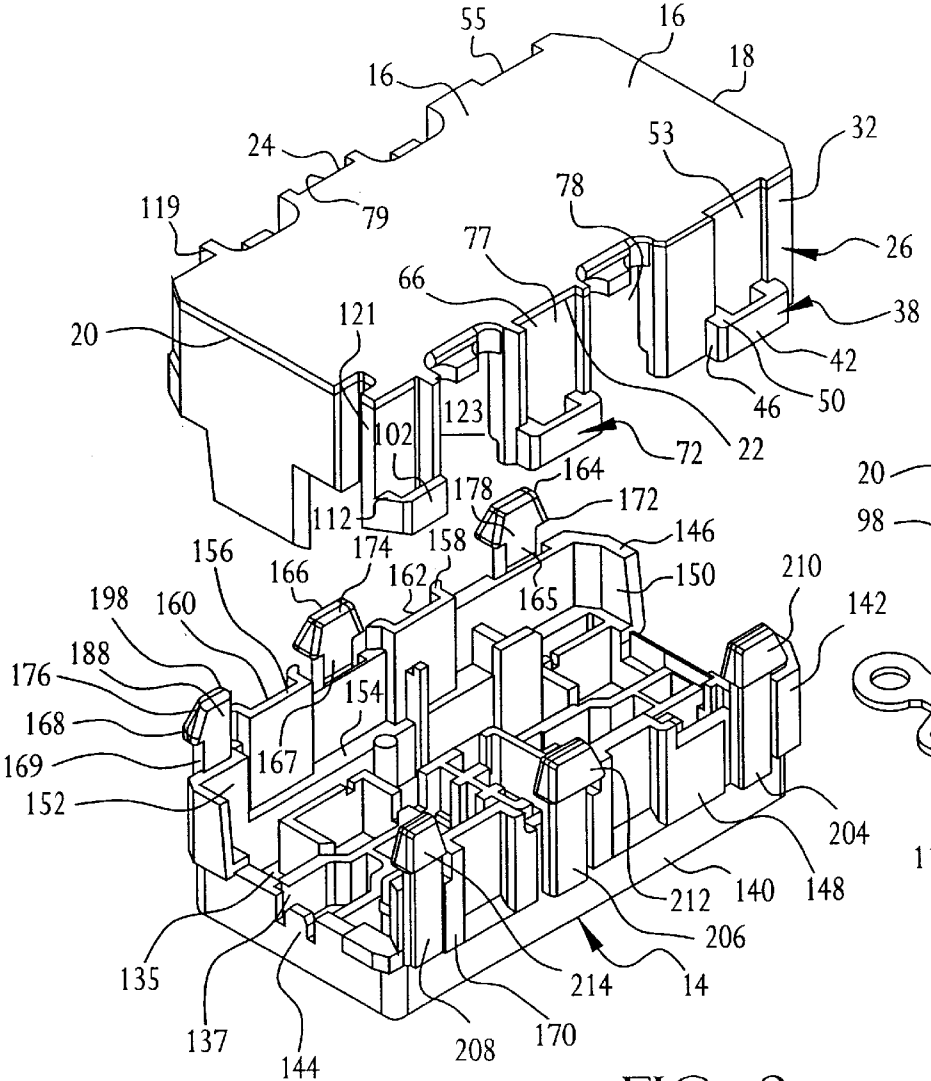
FIG. 3 is a bottom perspective view of the housing of FIG. 1, prior to engagement of the first and second pieces of the housing.

Sections or substantially rigid base walls 66 and 68 are adjacent walls 58 and 60 and are preferably unitary with and extend substantially perpendicular to planar surface 16. However, walls 66 and 68 can extend at any suitable angle relative to planar surface 16. Walls 66 and 68 are preferably rectangular and have hoop portions 70 and 72, respectively, which are substantially similar to design and use as hoop portions 38 and 40 and therefore will not be discussed in detail here. Each wall 66 and 68 has two ridges 74 and 76 that extend from planar surface 16 adjacent each wall's outside edges on the interior surface of walls 66 and 68 and terminate preferably before reaching the end of walls 66 and 68. Additionally, as seen in FIGS. 1 and 3, the exterior surface of walls 66 and 68 each have a groove or trench 77 and 79, respectively. Section 66 and 68, walls 58 and 60, and sections 32 and 34 of U-shaped portion 28 form U-shaped apertures or openings 78 and 80.

As shown in FIG. 7, adjacent sections 66 and 68 are two shorter or lower portions or walls 82 and 84 that are preferably unitary with and extend substantially perpendicular to planar surface 16. Walls 82 and 84 are similar to walls 58 and 60 described above. Walls 82 and 84 are recessed slightly inwardly toward the center of surface 16, relative to sections 66 and 68 and each wall 82 and 84 has a protrusion 86 and 88, respectively extending outwardly and substantially parallel with coplanar surface 16 therefrom. Protrusions 86 and 88 extend to about the same distance outwardly sections 66 and 68.

At second end 20, section 12 has another U-shaped portion 90 (FIGS. 1 and 7). U-shaped portion 90 is comprised of three, preferably unitary or integrally formed sections or substantially rigid base walls 92, 94 and 96. Section 92 extends along substantially the entire length of second end 20 and substantially perpendicularly from planar surface 16. Sections 94 and 96 each extend along a portion of sides 22 and 24, respectively and substantially perpendicularly from planar surface 16. However, sections 92, 94 and 96 do not necessarily need to be unitary and can be separate if desired and can extend at any suitable angle relative to planar surface 16. Section 92 is preferably slightly shorter or narrower than section 30 of U-shaped portion 28 and has a protrusion or extension 98 that projects away from planar surface 16 and is substantially coplanar with section 92. Additionally, section 92 is higher on the side of the projection adjacent wall 24 than on the side of the projection adjacent wall 22 and has an indentation or recess 93 adjacent wall 22.

Sections 94 and 96 each has a hoop portion or connecting unit 100 and 102 (FIGS. 1–4 and 7), respectively integrally or unitarily formed thereon. Hoop portions 100 and 102 are substantially similar and therefore only hoop portion 100 will be described herein. Hoop portion 100 is formed from three separate walls or portions 104, 106 and 108, as shown specifically in FIG. 7. The hoop portion also has a first end 110 and a second end 112. The three walls of the hoop portion 100 and section 94 are integrally formed or coupled together to define a through passageway or channel 114. Portion or connecting wall 104 has a normally substantially planar configuration and is substantially parallel to and spaced from section 94. Wall 106 extends substantially perpendicular from and is preferably unitary with section 94 and wall 106, while wall 108 is also preferably unitary or integral with section 94 and wall 106, wall 108 extends at an angle other than 90-degrees from section 94 and wall 106. However, each wall can extend at any desired angle relative to section 94. The interior portion of walls 104 and 108 taper downwardly and inwardly. Wall 104 is preferably about 0.204±0.005 inches at its shortest length and about 0.213±0.005 at its widest. Walls 106 and 108 are preferably about 0.09±0.005 inches at their shortest length and about 0.11±0.005 at their widest. The short length of walls 104 and 108 and wall 106 and section 94 form a narrow portion 51 in through passageway 52, narrow portion 51 having a perimeter A'. Perimeter A' is preferably about 0.588 inches, but may be any measurement that allows the housing to couple together as described herein and walls 104, 106 and 108 do not necessarily need to be the lengths stated and may be any length desired. Additionally, sections 94 and 96 each have a ridge or wall 119 and 121, respectively that extends along the exterior surface adjacent walls 82 and 84, respectively. Sections 66 and 68, walls 82 and 84, and sections 94 and 96 of U-shaped portion 90 form U-shaped apertures or openings 123 and 125.

As seen in FIGS. 1 and 2, second section or cover portion 14 is preferably a plastic, such as nylon (specifically, ZYTEL 101F NC010, as described above) but can be any thermoplastic, polymer or synthetic nonconductive material.

Second section 14 is preferably a molded portion of the housing having a substantially smooth, planar surface or second wall 124. Surface 124 preferably has openings or apertures 126 therethrough for two electrical plugs or outlets. However, surface 124 can have any number of openings for any type of electrical device or it can have no openings. Additionally, surface 124 preferably has openings or apertures 128 for test 129 or reset 131 buttons, as are known to one of ordinary skill in the art. The interior surface 135 of portion 14 has walls or raised portions 137 that generally trace or outline apertures 126 and 128, as seen specifically in FIG. 3.

Cover portion 14 has a first end 130, a second end 132, a first side 134, a second side 136, and is surrounded by a perimeter wall 138. Wall 138 preferably extends substantially perpendicularly from planar surface 124, but may extend at any suitable angle. Wall 138 is formed of upper portion 140 and lower portion 142. Upper portion 140 is preferably smooth and preferably extends substantially entirely around surface 124, except at second end 132, wherein two small grooves are cut out of upper portion 140 forming tongue 144.

Lower portion 142 is preferably unitary or integral with upper portion 140 and is comprised of two preferably substantially similar portions 146 and 148. However, it is not necessary for the portions to be similar and each may be any configuration desired. Portion 146 extends downwardly from upper portion 140 and substantially the entire length of first side 134 and along a portion of first and second ends 130 and 132, as seen specifically in FIGS. 1–3. Lower portion 146 is preferably substantially parallel to and extends from upper portion 140 in such a manner that inner surface 150 of lower surface 146 is in substantially the same plane as outer surface 152 of upper portion 140, defining upper portion end surface 154 and lower portion end surface 155. However, upper portion 140 and lower portion 146 do not necessarily have to be parallel or have coplanar inner and outer surfaces and one can extend from the other in any manner desired, such as coplanar or any other angle. Additionally, lower portion 146 has two sections 156 and 158 that extend from end surface 154 of upper portion 140 farther than the rest of lower portion 146, as seen specifically in FIG. 3. Sections 156 and 158 each have a groove or recess 160 and 162, respectively.

Figure 5:
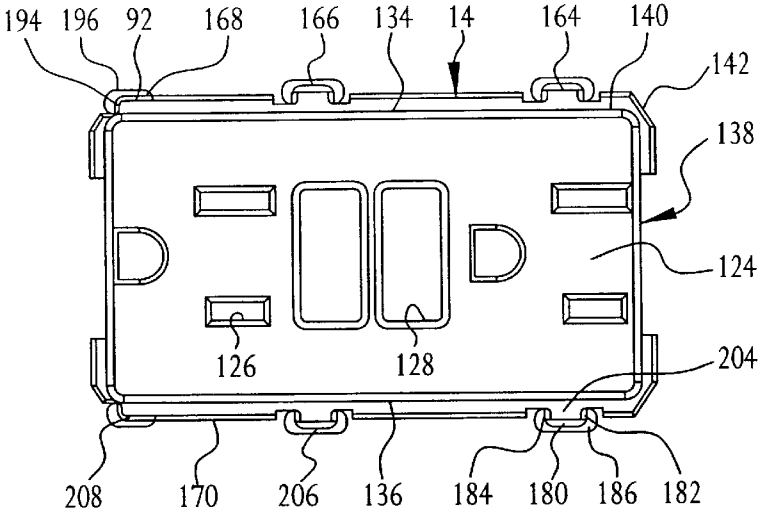
FIG. 5 is a top plan view of the second piece of the housing of FIG. 1.

Lower portion 146 has three substantially inflexible or rigid, rectangular posts or elongate members 164, 166 and 168 extending therefrom having a cross-sectional area B with a perimeter that is less than the narrow portion of channel 52 or perimeter A, as seen specifically in FIGS. 11*a–e* and 12*a–e*. Each post is coupled to and preferably integral or unitary with exterior surface 170 of portion 146. As seen in FIGS. 1–4, posts 164, 166 and 166 each have a body portion 165, 167 and 169 that extend outwardly and downwardly from portion 146 and terminate into a tapered protrusion or barb 172, 174 or 176, respectively, at the distal end thereof. Protrusions or wedges 172 and 174 are substantially similar and therefore, only protrusion 172 will be described herein. As seen in FIGS. 1 and 5, protrusion 172 is substantially coplanar or flush with surface 178 of barb 164, but extends or protrudes substantially perpendicularly from surfaces 180, 182 and 184, defining a rear substantially planar surface 186 having a perimeter C. Perimeter C has a cross-sectional area that is greater than the narrow portion of channel 52 or perimeter A, as seen specifically in FIGS. 11*a–e* and 12*a–e*. Perimeter C is preferably about 0.76 inches and has two sides F that are preferably about 0.10±0.005 inches and two sides G that are about 0.28±0.005 inches; however the perimeter and length of the sides of the barb may be any measurement that allows the housing to couple together as described herein. Protrusion or wedge 172 of barb 164 does not necessarily need to be perpendicular relative to surfaces 180, 182 or 184 and may extend at any angle (acute, obtuse or otherwise) from any of the sides and not necessarily the same angle from each side. Protrusion 172 tapers downwardly and inwardly to an end or point 186. Additionally, both the body portions 165, 167 and 169 and the protrusions 172, 174 and 176 of the posts 164, 166 and 168 may be any configuration desired, such as oval, circular, triangular or any other suitable polygon. Post 168 is set in farther toward the center of portion 14 than posts 164 and 166, but is otherwise substantially similar to posts 164 and 166.

Figure 6:
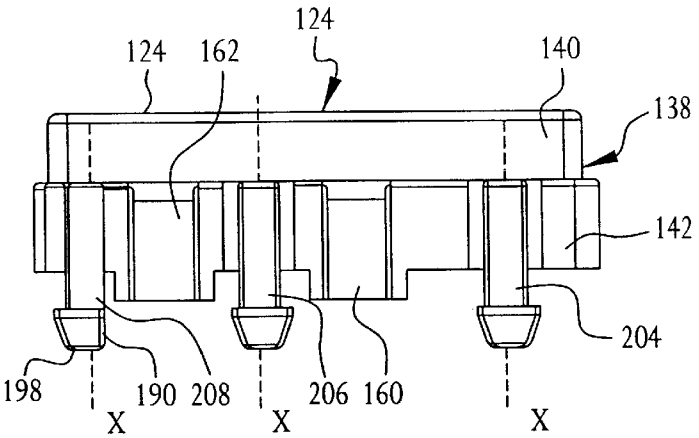
FIG. 6 is a side elevational view of the second piece of the housing of FIG. 5.
Figure 8:
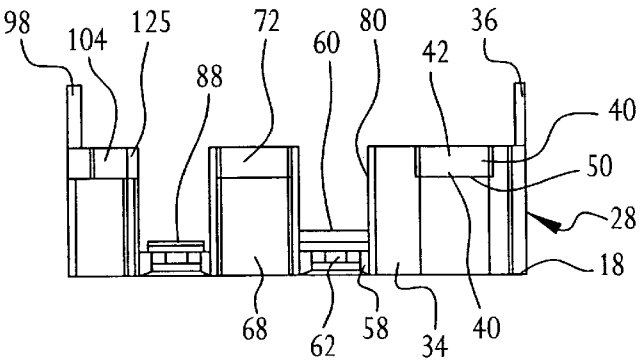
FIG. 8 is a side elevational view of the first piece of the housing of FIG. 8.

As seen in FIGS. 1 and 6, protrusion 176 is similar to protrusions 172 and 174 and the discussion of protrusion 172 applies to protrusion 176; except protrusion 176 is substantially coplanar or flush with both sides 188 and 190 and extends or protrudes substantially perpendicularly from surfaces 192 and 194, defining a rear substantially planar surface 196. Surface 196 defines a cross-sectional area having a perimeter B' that is less than the narrow portion of channel 114 or perimeter A'. Perimeter B' is preferably about 0.68 inches and has two sides that are preferably about 0.10±0.005 inches and two sides that are about 0.24±0.005 inches; however the perimeter and length of the sides of the barb may be any measurement that allows the housing to couple together as described herein. Protrusion 176 tapers downwardly and inwardly to an end or point 198.

Portion 148 is substantially similar to portion 146, described above and the description of portion 146 applies to portion 148. Portion 148 has three elongate members or posts 204, 206 and 208 that are substantially similar to posts 164, 166 and 168 described above, each post having a protrusion 210, 212 and 214, respectively. However, portion 148 does not extend along second end 132 in the same manner as portion 146. As seen in FIG. 3, portion 148 ends at comer 200 of upper portion 140 and along second end 132, member 202 extends outwardly and away from end 132.

It is noted that the housing 10, as described above, preferably has six hoop portions and six posts that couple together on a one-to-one basis, but is possible that the housing can have as few as one hoop/post connection and as many as desired (i.e. 2–5 or greater than 6) to achieve the coupling of the two pieces of the housing described above.

Assembly

Figure 10:
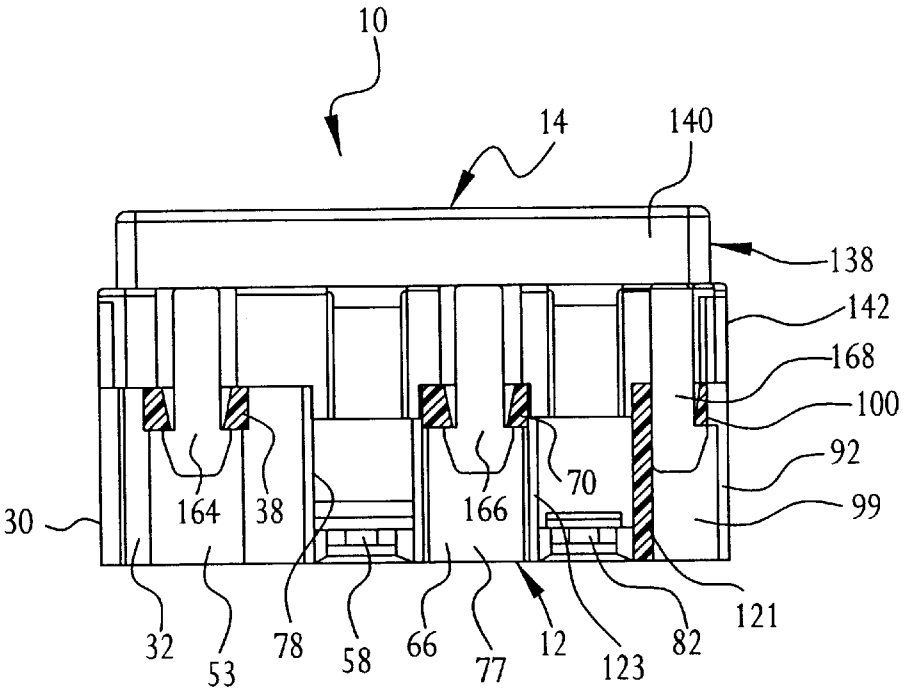
FIG. 10 is a side view in section of the housing of FIG. 9, taken along lines 10—10.
Figure 9:
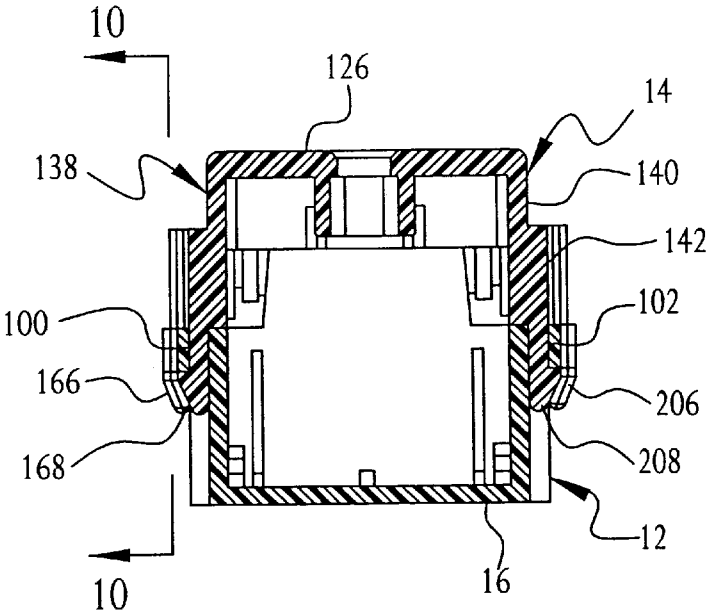
FIG. 9 is an end view in section of the housing of FIG. 2, after engagement of the first and second pieces of the housing.

As seen in FIGS. 1–6, to assemble housing 10, first section 12 and second section 14 are moved toward each other along longitudinal axis X of elongate members 164, 166, 168, 204, 206 and 208. Protrusions 172, 174 and 176 are inserted into channels 52 of hoop portions 40 and 72 and channel 114 of hoop portion 102, respectively, and protrusions 210, 212 and 214 are inserted into channels 52 of hoop portions 38 and 70 and channel 114 of hoop portion 112, respectively. The tapered walls of the protrusions engage the tapered walls of the hoop portions. As the protrusions are further inserted, the perimeters A and A' of the hoop portions are increased or resiliently expanded, as seen specifically in FIGS. 11*d* and 12*d*, while the base walls or sections (32, 34, 66, 68, 94 and 96) and the elongate members remain substantially stationary. In other words, as the protrusion or barb passes through channel 52 or 114, at least a portion of the connecting walls resiliently flex outwardly or away from the sections or base walls of the hoop and the elongate members and base walls do not substantially bend. At least a portion of each wall and preferably each entire wall is adapted to stretch when the protrusion passes through the channel 52. The walls expand since the length of walls D and E are shorter than sides G and F of the barb or protrusion, respectively. In other words, the ratio of the length of wall D to side G is between about 0.83 to 0.90 and the ratio of the length of wall E to side F is between about 0.70 and 0.90. When the protrusion passes entirely through the channel or aperture and the end surface of each protrusion engages the abutment or end surface of the hoop portion, as seen specifically in FIGS. 2, 9 and 10, the walls of the hoop portions return to a normal, unstretched position under their natural resiliency with a portion of the elongate member, preferably the body portion, remaining in the aperture. The hoop portion is designed to withstand a certain outwardly directed hoop stress that allows it to expand without breaking or permanently deforming, and to contact inwardly once the barb passes therethrough.

When the sections 12 and 14 are assembled, lower portion 142 of section 14 and openings 78, 80, 123 and 125 preferably form a rectangular opening allowing access to the interior of the housing 10. These openings enable a connection, for example, a screw 216 or other type of connection, for hot and neutral wires or any type of desired electrical connection as is know in the art. Additionally, the lower portion of section 92 allows another access opening in housing 10 for an electrical connection 220, such as a grounding wire. Additionally, extensions 36 and 98 are slightly spaced from upper wall 140 of housing portion 14, allowing the bridge 218 for the electrical duplex to pass therethrough.

This assembly allows the two parts of the housing to be snap-fitted together easily and simply while making it extremely difficult to pull or twist the two halves apart. Specifically, the perimeter of cross-section of the end surface of each protrusion or barb is significantly larger that the respective channel in the hoop portion, and therefore it is very difficult to pull the barb backwardly through the aperture, without using a device or mechanism to stretch each hoop portion. The end surface of the protrusion simply abuts or contacts the end surface of its respective hoop portion. Additionally, the redundancy of the posts and the general rigidity of the housing make the housing resistant to twisting and the two pieces of the housing are therefore not likely to be pulled apart.

While a specific embodiment has been chosen to illustrate the invention, it will be understood by those skilled in the art that various changes and modifications can be made therein without departing from the scope of the invention as defined in the appended claims.

What is claimed is:

1. An electrical wiring device housing, comprising:

a first section having a first wall, a first side wall extending from said first wall, and a connecting unit extending from said first side wall, said connecting unit having a connecting wall that has a normally substantially planar configuration and is spaced from said first side wall, a first member connecting said connecting wall to said first side wall and having a normally substantially planar configuration and an end wall that is adjacent said connecting wall and said first member; and a second section having a second wall, a second side wall extending from said second wall, and a post extending from said second wall and having a barb at the distal end thereof, said barb having first and second protrusions extending outwardly relative to said post, said barb adapted to pass between said connecting wall, said first member and said first side wall and said first and second protrusions engage said end wall of said connecting unit adjacent said connecting wall and said first member;

said first side wall remaining substantially stationary while at least a portion of said connecting wall flexes away from said first side wall and at least a portion of said first member flexes outwardly when said barb passes therebetween, said first and second protrusions contacting said connecting wall and said first member, respectively, causing said flexing and said connecting wall and said first member returning to said normally substantially planar configurations when said barb engages said end wall.

2. An electrical wiring device housing according to claim 1, wherein said barb has a side G, said side G being longer than said connecting wall.

3. An electrical wiring device housing according to claim 2, wherein said connecting wall and said side G have a ratio between about 0.83 and 0.90.

4. An electrical wiring device housing according to claim 1, where in said barb has a side F, said side F being longer than said first sidewall.

5. An electrical wiring device housing according to claim 4, wherein said first sidewall and said side F have a ratio between about 0.70 and 0.90.

6. An electrical wiring device housing according to claim 1, wherein said connecting wall is coupled to said sidewall by said first member and a second member, a portion of said second member flexing outwardly when said barb passes between said connecting wall and said first sidewall.

7. An electrical wiring device housing according to claim 6, wherein said connecting wall, said first sidewall and said first and second members form a substantially rectangular through passageway.

8. An electrical wiring device housing according to claim 7, wherein said connecting wall and said first and second members are tapered downwardly and inwardly, forming a narrow portion of said through passageway.

9. An electrical wiring device housing according to claim 8, wherein said post has a cross-sectional area that is less than the cross-sectional area of said narrow portion of said through passageway.

10. An electrical wiring device housing according to claim 6, wherein said connecting wall, said first side wall and said first and second members form a continuous hoop.

11. An electrical wiring device housing according to claim 10, wherein a portion of said hoop is resilient.

12. An electrical wiring device housing according to claim 1, wherein said connecting wall is tapered inwardly, toward said first sidewall.

13. An electrical wiring device housing according to claim 6, wherein said barb has a rear substantially planar surface and said rear substantially planar surface engages said end wall.

14. An electrical wiring device housing according to claim 13, wherein said rear substantially planar surface engages said end wall and said first and second members.

15. An electrical wiring device housing according to claim 1, further comprising a second connecting unit extends from said first side wall and has a second connecting wall and a second end wall; and a second post extends from said second side wall, said second post having a second barb, and said second barb adapted to pass between said second connecting wall and said first side wall and engage said second end wall of said second connecting unit.

16. A receptacle housing for an electrical device, comprising:

a backing portion having a base and at least one section extending from said base, said at least one section having an exterior channel extending therefrom with first, second and third walls and first and second end surfaces; and a cover portion adapted to couple to said backing portion having a face with at least one aperture therein for said electrical device, at least one side wall extending from said face, and at least one substantially inflexible post extending from said at least one side wall and having a body portion and a protrusion thereon, said protrusion adapted to pass through said exterior channel;

at least a portion of said first, second and third walls adapted to stretch outwardly said protrusion passes through said exterior channel while said at least one section remains substantially stationary, and said protrusion adapted to engage said second end surface of said channel adjacent said first, second and third walls after passing through said channel, said body portion of said post being positioned within said channel without substantially stretching said first, second, or third walls when said protrusion engages said second end surface.

17. A receptacle housing according to claim 16, wherein said channel forms a substantially rectangular through passageway.

18. A receptacle housing according to claim 16, wherein said first, second, and third walls and said at least one section form a continuous hoop.

19. A receptacle housing according to claim 16, wherein said first, second, and third walls each have a downwardly and inwardly tapering portion, said tapering portions defining a narrow portion of said channel.

20. A receptacle housing according to claim 19, wherein said body portion of said post has an outer perimeter that is less than the perimeter of said narrow portion of said channel.

21. A receptacle housing according to claim 16, wherein said protrusion is tapered and forms a wedge.

22. A receptacle housing according to claim 16, wherein said protrusion has a rear substantially planar surface and said rear substantially planar surface engages said second end surface of said exterior channel.

23. A receptacle housing according to claim 16, further comprising at least two sections each having an exterior channel extending therefrom; and at least two side walls each having at least one inflexible post extending therefrom, each post having a body portion and a protrusion thereon, each said protrusion adapted to pass through a respective exterior channel.

24. An electrical wiring device housing, comprising a first section having a substantially rigid base wall and a hoop portion integrally formed with said base wall, said base wall and said hoop portion forming an aperture having a perimeter A, said hoop portion being formed of resilient material and an end surface; and a second portion having an elongated member with a barb at a distal end thereof, said barb having a largest outer perimeter B, said outer perimeter B being greater than perimeter A, and said barb having an abutment surface, said abutment surface extending at least half way around said outer perimeter B;

a portion of said elongate member being received in said aperture and said barb being located adjacent said aperture with said abutment surface engaging said base wall and said end surface, thereby resisting movement of said barb through said aperture.

25. An electrical wiring device housing according to claim 24, wherein said aperture forms a substantially rectangular through passageway.

26. An electrical wiring device housing according to claim 25, wherein said through passageway has a downwardly and inwardly tapering portion, said tapering portion defining a narrow portion of said through passageway.

27. A method for enclosing an electrical device in a receptacle housing having a first section with a substantially rigid base wall and a hoop portion integrally formed with said base wall, said base wall and said hoop portion forming an aperture defining a perimeter and being formed of resilient material, and having a second portion with an elongated member having a longitudinal axis and having a barb at a distal end thereof, said barb having an abutment surface and defining an outer perimeter, the outer perimeter being larger than the perimeter of the aperture, and the abutment surface extending at least half way around the outer perimeter B, comprising the steps of moving the first section and the second section toward each other along the longitudinal axis of the elongate member, inserting the barb in the aperture, the barb increasing the perimeter of the hoop portion, while the base wall remains substantially stationary, passing the barb through the aperture, engaging the abutment surface with the hoop portion, and returning the hoop portion to a normal, unstretched position, a portion of the elongate member remaining within the aperture.

* * * * *